US011846956B2

(12) United States Patent
Zhong

(10) Patent No.: US 11,846,956 B2
(45) Date of Patent: Dec. 19, 2023

(54) LINEAR VOLTAGE REGULATOR WITH STABILITY COMPENSATION

(71) Applicant: Chengdu Monolithic Power Systems Co., Ltd., Chengdu (CN)

(72) Inventor: Changxian Zhong, Chengdu (CN)

(73) Assignee: Chengdu Monolithic Power Systems Co., Ltd., Chengdu (CN)

( * ) Notice: Subject to any disclaimer, the term of this patent is extended or adjusted under 35 U.S.C. 154(b) by 139 days.

(21) Appl. No.: 17/547,512

(22) Filed: Dec. 10, 2021

(65) Prior Publication Data

US 2022/0206519 A1 Jun. 30, 2022

(30) Foreign Application Priority Data

Dec. 31, 2020 (CN) ..... 202011644672.8

(51) Int. Cl.
*G05F 1/46* (2006.01)

(52) U.S. Cl.
CPC ..... *G05F 1/461* (2013.01); *G05F 1/468* (2013.01)

(58) Field of Classification Search
CPC ..... G05F 1/461; G05F 1/468
See application file for complete search history.

(56) References Cited

U.S. PATENT DOCUMENTS

2010/0019747 A1* 1/2010 Kao ..... G05F 1/56 323/274
2014/0217999 A1* 8/2014 Wibben ..... G05F 1/468 323/282
2017/0357278 A1* 12/2017 Bernardon ..... G05F 1/575

* cited by examiner

*Primary Examiner* — Jue Zhang
*Assistant Examiner* — Lakaisha Jackson
(74) *Attorney, Agent, or Firm* — Perkins Coie LLP

(57) ABSTRACT

A linear voltage regulator includes a transistor, an error amplifier, a feedback circuit and a compensation circuit. The transistor has a first terminal for receiving an input voltage, a second terminal for providing an output voltage, and a control terminal. The error amplifier has a first input terminal, a second input terminal and an output terminal, wherein the first input terminal receives a reference voltage, and the output terminal is coupled to the control terminal of the transistor. The feedback circuit receives the output voltage and generates a feedback voltage lower than the output voltage. The compensation circuit is configured to receive the feedback voltage and generate a compensation voltage at the second input terminal of the error amplifier. The compensation circuit includes a compensation capacitor for introducing a zero point into an open-loop transfer function of the linear voltage regulator to improve system stability.

18 Claims, 5 Drawing Sheets

LINEAR VOLTAGE REGULATOR WITH STABILITY COMPENSATION

CROSS-REFERENCE TO RELATED APPLICATIONS

This application claims the benefit of CN application 202011644672.8, filed on Dec. 31, 2020, and incorporated herein by reference.

TECHNICAL FIELD

The present invention generally relates to electronic circuits, and more particularly but not exclusively, relates to linear voltage regulators.

BACKGROUND

Due to its simple structure, low cost, and low quiescent current, LDO (low dropout linear voltage regulator) is widely used in applications where the output voltage is close to the input voltage. In order to maintain system stability, a compensation circuit is usually incorporated into the control loop of the LDO.

FIG. 1 is a schematic diagram of a prior art LDO, which includes a transistor M1, resistors R1, R2, and an error amplifier AMP1. A capacitor C1 is coupled in parallel with the resistor R1 to introduce a zero point into the open-loop transfer function of the LDO, thereby enhancing the system stability. With regard to the circuit shown in FIG. 1, when the output voltage Vout is a high voltage, the capacitor C1 also needs to have a high rated voltage. In integrated circuits, the capacitor C1 is usually implemented by an on-chip capacitor. For on-chip capacitors with the same capacitance, a higher rated voltage means a larger chip area, which will adversely affect cost and size of the chip.

SUMMARY

Embodiments of the present invention are directed to a linear voltage regulator comprising a first transistor, a first error amplifier, a feedback circuit and a compensation circuit. The first transistor has a first terminal, a second terminal and a control terminal, wherein the first terminal is configured to receive an input voltage, and the second terminal is configured to provide an output voltage. The first error amplifier has a first input terminal, a second input terminal and an output terminal, wherein the first input terminal is configured to receive a reference voltage, and the output terminal is coupled to the control terminal of the first transistor. The feedback circuit has an input terminal and an output terminal, wherein the input terminal is coupled to the second terminal of the first transistor to receive the output voltage, and the feedback circuit is configured to generate a feedback voltage lower than the output voltage at its output terminal. The compensation circuit is coupled between the output terminal of the feedback circuit and the second input terminal of the first error amplifier, and configured to generate a compensation voltage at the second input terminal of the first error amplifier based on the feedback voltage. The compensation circuit includes a compensation capacitor and is configured to introduce a zero point into an open-loop transfer function of the linear voltage regulator to improve stability of the linear voltage regulator.

Embodiments of the present invention are also directed to a semiconductor integrated circuit, comprising a first pin configured to receive an input voltage, a second pin configured to provide an output voltage, and a third pin coupled to a reference ground. The semiconductor integrated circuit also includes a first transistor, a first error amplifier, a second transistor, a first resistor, a second resistor and a compensation circuit. The first transistor has a first terminal, a second terminal and a control terminal, wherein the first terminal is coupled to the first pin, and the second terminal is coupled to the second pin. The first error amplifier has a first input terminal, a second input terminal and an output terminal, wherein the first input terminal is configured to receive a reference voltage. The second transistor has a first terminal, a second terminal and a control terminal, wherein the first terminal is coupled to the control terminal of the first transistor, the second terminal is coupled to the reference ground, and the control terminal is coupled to the output terminal of the first error amplifier. The first resistor has a first terminal and a second terminal, wherein the first terminal is coupled to the second pin. The second resistor has a first terminal and a second terminal, wherein the first terminal of the second resistor and the second terminal of the first resistor are coupled together to provide a feedback voltage, and the second terminal of the second resistor is coupled to the reference ground. The compensation circuit has an input terminal and an output terminal, wherein the input terminal is coupled to receive the feedback voltage, and the output terminal is coupled to the second input terminal of the first error amplifier to provide a compensation voltage. The compensation circuit includes a compensation capacitor and is configured to introduce a zero point into an open-loop transfer function of the linear voltage regulator to improve stability of the linear voltage regulator.

Embodiments of the present invention are further directed to a stability compensation method of a linear voltage regulator. The linear voltage regulator comprises a transistor coupled between an input voltage and an output voltage, and an error amplifier for controlling the transistor. The stability compensation method comprising: converting the output voltage into a feedback voltage lower than the output voltage through a resistor divider; converting the feedback voltage into a compensation voltage different from the feedback voltage through a compensation circuit, wherein the compensation circuit includes a compensation capacitor for introducing a zero point into an open-loop transfer function of the linear voltage regulator to improve stability of the linear voltage regulator; and comparing the compensation voltage with a reference voltage through the error amplifier, to generate a voltage for controlling the transistor.

According to the embodiments of the present invention, even when the output voltage is a high voltage, the rated voltage of the compensation capacitor could still be a low voltage value. Therefore, the chip area required for the compensation capacitor is highly reduced, especially compared with the capacitor C1 shown in FIG. 1.

BRIEF DESCRIPTION OF THE DRAWING

The present invention can be further understood with reference to following detailed description and appended drawings, wherein like elements are provided with like reference numerals.

DETAILED DESCRIPTION

Reference will now be made in detail to the preferred embodiments of the invention, examples of which are illustrated in the accompanying drawings. While the invention will be described in conjunction with the preferred embodiments, it will be understood that they are not intended to limit the invention to these embodiments. On the contrary, the invention is intended to cover alternatives, modifications and equivalents, which may be included within the spirit and scope of the invention as defined by the appended claims. Furthermore, in the following detailed description of the present invention, numerous specific details are set forth in order to provide a thorough understanding of the present invention. However, it will be obvious to one of ordinary skill in the art that the present invention may be practiced without these specific details. In other instances, well-known methods, procedures, components, and circuits have not been described in detail so as not to unnecessarily obscure aspects of the present invention.

Reference to "one embodiment", "an embodiment", "an example" or "examples" means: certain features, structures, or characteristics are contained in at least one embodiment of the present invention. These "one embodiment", "an embodiment", "an example" and "examples" are not necessarily directed to the same embodiment or example. Furthermore, the features, structures, or characteristics may be combined in one or more embodiments or examples.

In addition, it should be noted that the drawings are provided for illustration, and are not necessarily to scale. And when an element is described as "connected" or "coupled" to another element, it can be directly connected or coupled to the other element, or there could exist one or more intermediate elements. In contrast, when an element is referred to as "directly connected" or "directly coupled" to another element, there is no intermediate element. When a signal is described as "equal to" another signal, it is substantially identical to the other signal.

Figure 2:
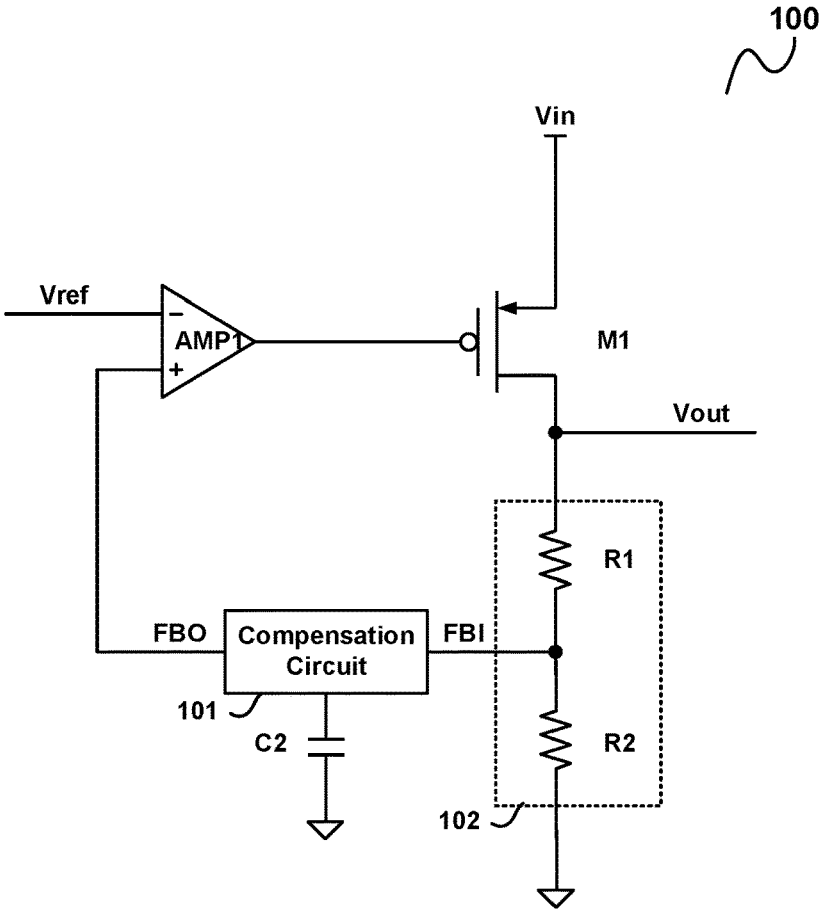
FIG. 2 schematically illustrates an LDO 100 in accordance with an embodiment of the present invention.

FIG. 2 schematically illustrates an LDO 100 in accordance with an embodiment of the present invention. The LDO 100 comprises a transistor M1, an error amplifier AMP1, a compensation circuit 101, and a feedback circuit 102. The transistor M1 has a first terminal, a second terminal and a control terminal, wherein the first terminal is configured to receive an input voltage Vin, and the second terminal is configured to provide an output voltage Vout. The input voltage Vin is normally provided by a power supply (e.g., a battery or a front-stage converter), and the output voltage Vout is provided to a load (e.g., an electric device or a downstream converter). In some applications, an output capacitor or a load capacitor is coupled between the output voltage Vout and a reference ground. The error amplifier AMP1 has a first input terminal, a second input terminal and an output terminal, wherein the first input terminal is configured to receive a reference voltage Vref, and the output terminal is coupled to the control terminal of the transistor M1.

The feedback circuit 102 has an input terminal and an output terminal, wherein the input terminal is coupled to the second terminal of the transistor M1 to receive the output voltage Vout. Based on the output voltage Vout, the feedback circuit 102 generates a feedback voltage FBI at its output terminal. As shown in FIG. 2, the feedback circuit 102 could include a resistor divider with resistors R1 and R2. The resistors R1 and R2 each have a first terminal and a second terminal. The first terminal of the resistor R1 is coupled to the second terminal of the transistor M1. The second terminal of the resistor R1 and the first terminal of the resistor R2 are coupled together to provide the feedback voltage FBI. The second terminal of the resistor R2 is coupled to the reference ground. Based on this configuration, the feedback voltage FBI is a scaled-down value of the output voltage Vout, and could be expressed as:

$$FBI = Vout * \frac{R2}{R1 + R2} \tag{1}$$

The compensation circuit 101 is coupled between the output terminal of the feedback circuit 102 and the second input terminal of the error amplifier AMP1, and is configured to generate a compensation voltage FBO based on the feedback voltage FBI. The compensation circuit 101 includes a compensation capacitor C2, and is configured to introduce a zero point into an open-loop transfer function of the LDO 100 to improve system stability. The compensation voltage FBO is provided to the second input terminal of the error amplifier AMP1 for comparison with the reference voltage Vref, so as to realize close-loop control of the output voltage Vout. Generally speaking, if the compensation voltage FBO is higher than the reference voltage Vref, the error amplifier AMP1 will adjust a driving voltage at the control terminal of the transistor M1 to reduce the current flowing through the transistor Ml, thereby lowering the output voltage Vout, and vice versa.

Figure 1:
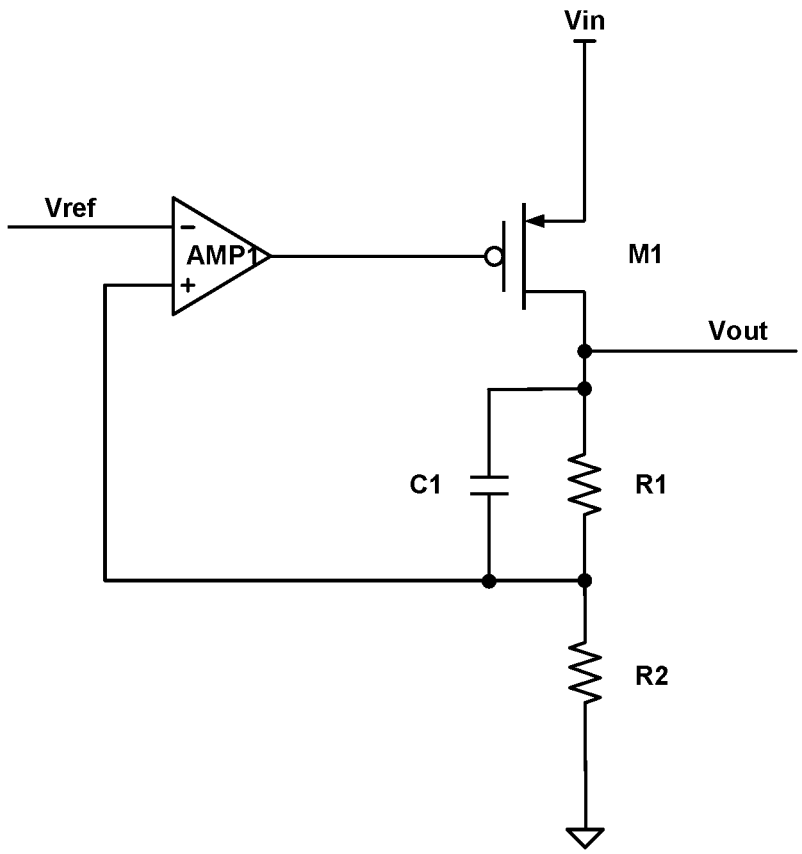
FIG. 1 (PRIOR ART)
FIG. 1 schematically illustrates a prior art LDO.

In the LDO 100, the reference voltage Vref is usually generated by a low-voltage bandgap circuit. The compensation voltage FBO used for comparison with the reference voltage Vref, and the feedback voltage FBI generated by the feedback circuit 102 are therefore also low voltages. Even when the output voltage Vout is a high voltage (e.g., around 40V), the rated voltage of the compensation capacitor C2 shown in FIG. 2 could still be a low voltage value (e.g., less than 6V). Therefore, compared with the capacitor C1 shown in FIG. 1, the chip area required for the compensation capacitor C2 is highly reduced.

Figure 3:
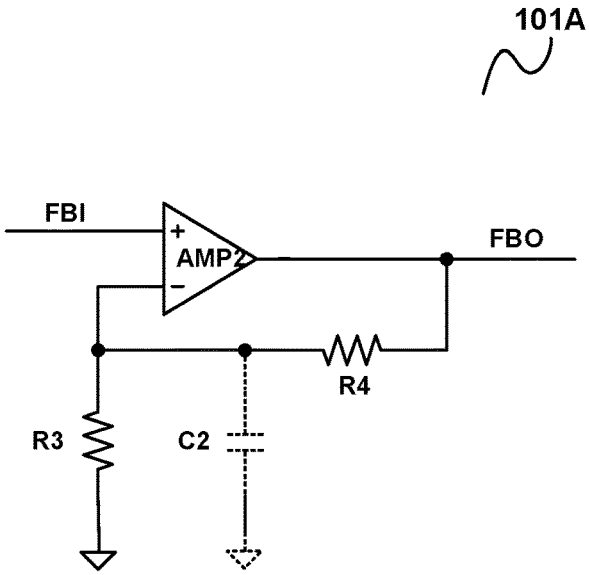
FIG. 3 schematically illustrates a compensation circuit 101A in accordance with an embodiment of the present invention.

FIG. 3 schematically illustrates a compensation circuit 101A in accordance with an embodiment of the present invention. The compensation circuit 101A includes an operational amplifier AMP2, resistors R3, R4, and a compensation capacitor C2. The operational amplifier AMP2 has a first input terminal, a second input terminal and an output terminal. The first input terminal is coupled to the feedback circuit to receive the feedback voltage FBI, and the output terminal is configured to provide the compensation voltage FBO. The resistor R3 is coupled in parallel with the compensation capacitor C2, and is coupled between the second input terminal of the operational amplifier AMP2 and the reference ground. The resistor R4 is coupled between the second input terminal of the operational amplifier AMP2 and the output terminal of the operational amplifier AMP2. If the operational amplifier AMP2 is deemed as an ideal operational amplifier (both of its bandwidth and open-loop gain are infinite), the transfer function of the compensation circuit 101A shown in FIG. 3 can be expressed as:

$$Gc = \frac{FBO}{FBI} = K * (\tau S + 1) \tag{2}$$

wherein:

$$K = \frac{R3 + R4}{R3} \tag{3}$$

$$\tau = \frac{R3 * R4}{R3 + R4} * C2 \tag{4}$$

Then, the system open-loop transfer function Go of the LDO 100 can be expressed as:

$$Go = \frac{FBO}{Vref - FBO} = \frac{Gm1 * Gm2 * K * (\tau S + 1)}{Geq1 * Geq2} * \frac{R2}{R1 + R2} \tag{5}$$

Gm1 is the transconductance coefficient of the error amplifier AMP1, Gm2 is the transconductance coefficient of the transistor M1, Geq1 is the equivalent conductance at the output terminal of the error amplifier AMP1, and Geq2 is the equivalent conductance at the second terminal of the transistor M1. It can be seen from equation (5) that the compensation circuit 101 introduces a zero point in the open-loop transfer function Go, which can be expressed as:

$$Zc = -\frac{1}{\tau} \tag{6}$$

Figure 4:
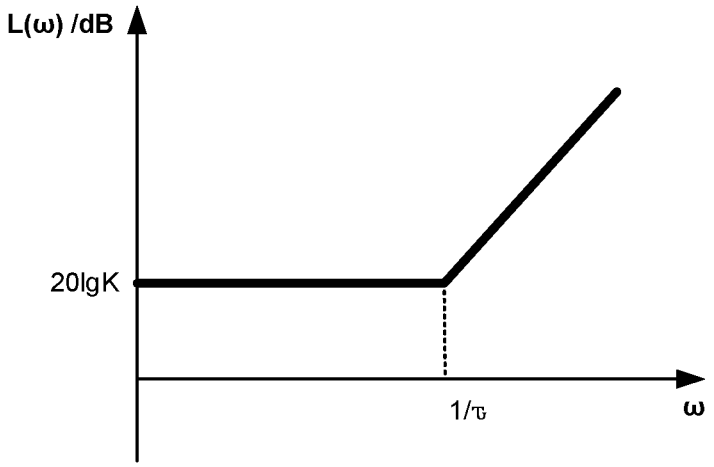
FIG. 4 is a Bode diagram of the compensation circuit 101A shown in FIG. 3 in accordance with an embodiment of the present invention.

FIG. 4 is a Bode diagram of the compensation circuit 101A shown in FIG. 3 in accordance with an embodiment of the present invention. The expected open-loop frequency characteristics of the system could be determined according to the required performance (such as system open-loop gain, cut-off frequency, phase margin, closed-loop bandwidth, etc.), and then the values of K and τ can be designed accordingly. Based on these values, component parameters of the compensation circuit could be obtained.

Figure 5:
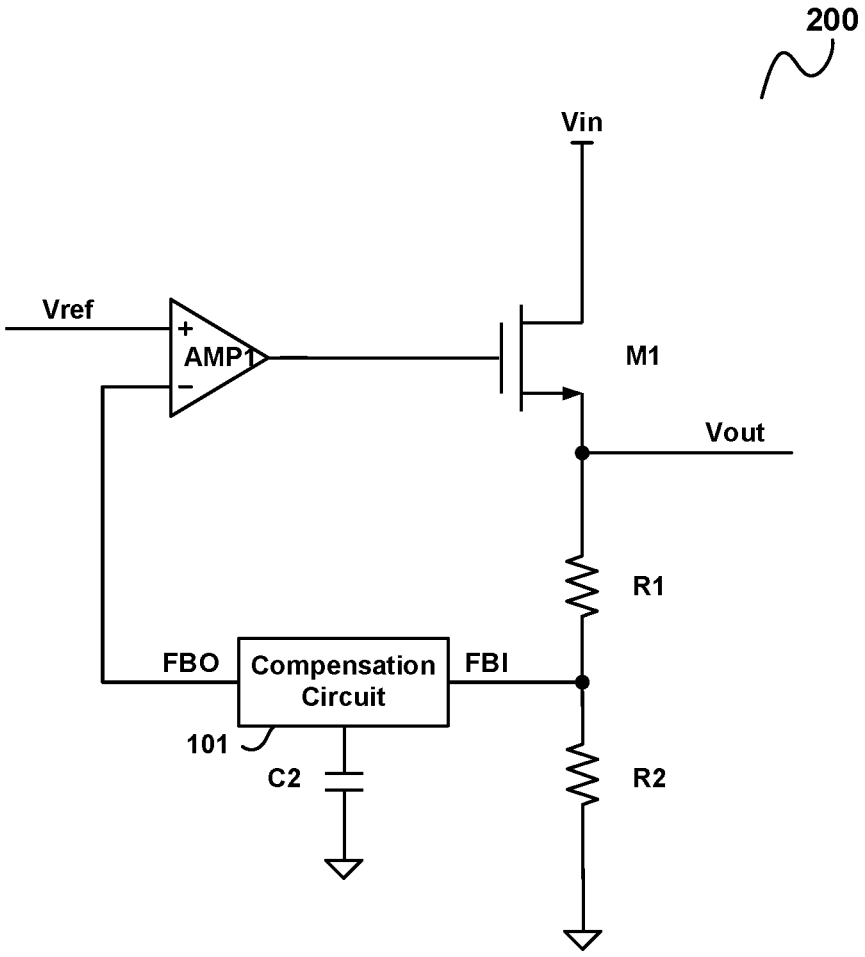
FIG. 5 schematically illustrates an LDO 200 in accordance with an embodiment of the present invention.

Although the transistor M1 shown in FIG. 3 is a PMOS (p-type metal oxide semiconductor field effect transistor), those skilled in the art could understand that NMOS, and PNP or NPN BJT (bipolar junction transistor) are also applicable in the present invention. FIG. 5 schematically illustrates an LDO 200 in accordance with an embodiment of the present invention, wherein the transistor M1 is an NMOS.

In addition to LDOs, the foregoing embodiments of the present invention can also be applied to load switch linear voltage regulators. The load switch, as another type of linear voltage regulator, has a structure similar to that of an LDO. The biggest difference between the two is that in the LDO, the reference voltage Vref is usually generated by a low-voltage bandgap circuit, and the output voltage Vout can be kept substantially constant even when the input voltage Vin changes. In the load switch, both the reference voltage Vref and the output voltage Vout gradually increase during a soft-start process. After the soft-start is over, typically the transistor in the load switch is completely turned on, so that the output voltage Vout could vary with the input voltage Vin.

Figure 6:
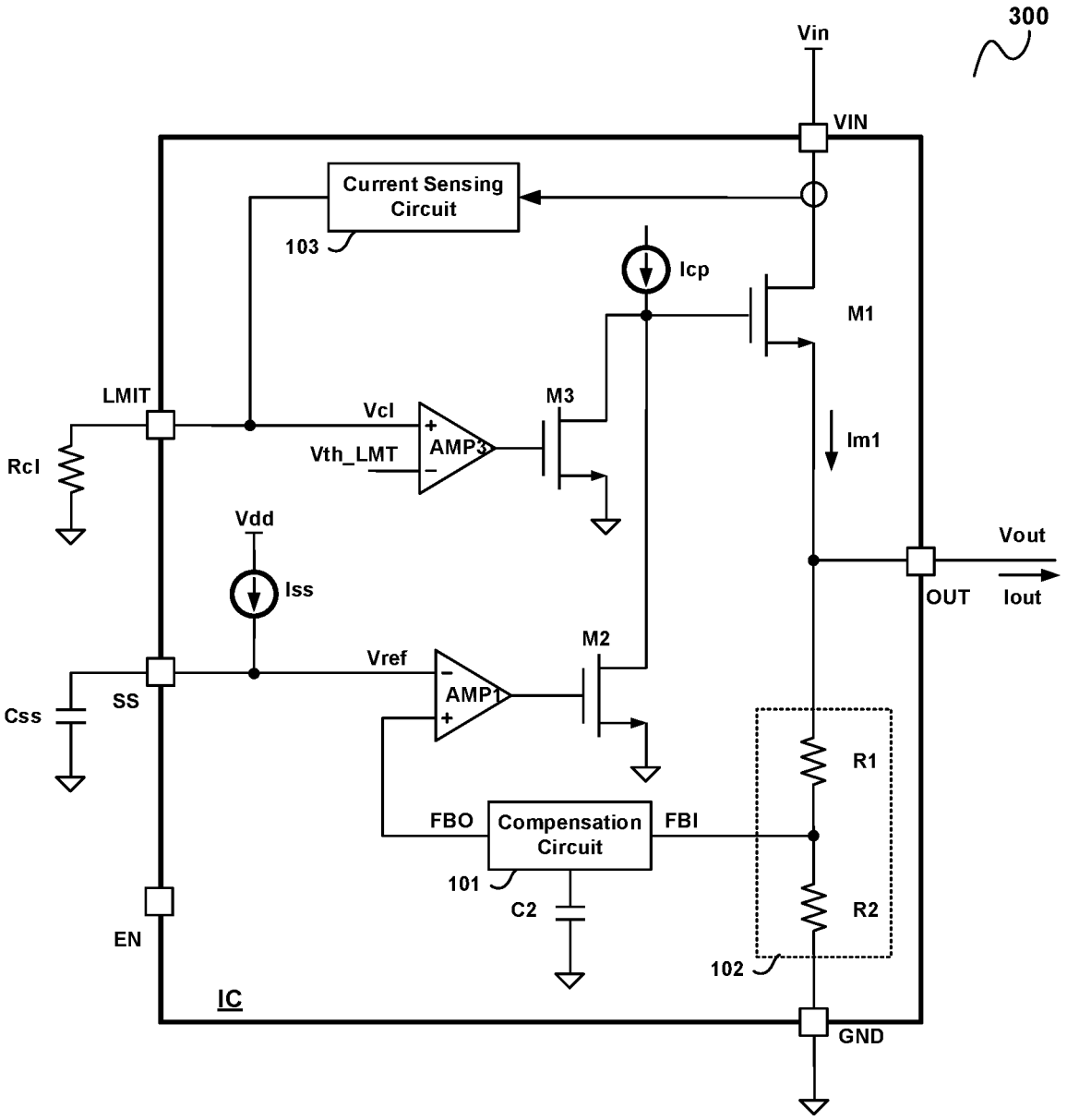
FIG. 6 schematically illustrates a load switch 300 in accordance with an embodiment of the present invention.

FIG. 6 schematically illustrates a load switch 300 in accordance with an embodiment of the present invention. The load switch 300 is a semiconductor integrated circuit (IC) with pins VIN, OUT, GND, and EN. The pin VIN is configured to receive the input voltage Vin, the pin OUT is configured to provide the output voltage Vout, and the pin GND is configured to couple the reference ground. The first terminal of the transistor M1 is coupled to the pin VIN, and the second terminal of the transistor M1 is coupled to the pin OUT. The first terminal of the resistor R1 is coupled to the pin OUT, the second terminal of the resistor R1 and the first terminal of the resistor R2 are coupled together to provide the feedback voltage FBI. The second terminal of the resistor R2 is coupled to the reference ground.

The compensation circuit 101 has an input terminal and an output terminal, wherein the input terminal is coupled to receive the feedback voltage FBI. The compensation circuit 101 generates a compensation voltage FBO at its output terminal based on the feedback voltage FBI. And through the compensation capacitor C2, the compensation circuit 101 introduces a zero point into the open-loop transfer function of the load switch 300 to improve system stability.

The first input terminal of the error amplifier AMP1 is configured to receive the reference voltage Vref, the second input terminal is coupled to the compensation circuit 101 to receive the compensation voltage FBO, and the output terminal is coupled to the control terminal of the transistor M1. In some exemplary embodiments, there may also be an intermediate element between the output terminal of the error amplifier AMP1 and the control terminal of the transistor M1, such as the transistor M2 shown in FIG. 6. The transistor M2 has a first terminal, a second terminal and a control terminal, wherein the first terminal is coupled to the control terminal of the transistor M1, the second terminal is coupled to the reference ground, and the control terminal is coupled to the output terminal of the error amplifier AMP1. In addition, as shown in FIG. 6, the load switch 300 could further include a current source Icp coupled to the control terminal of the transistor M1, and this current source is usually provided by a charge pump circuit.

The pin EN is used to receive an enable signal which determines a working state of the load switch 300. When the enable signal is valid (for example, at a logic high level), the load switch 300 works normally, and energy is transferred, through the transistor M1, from a power supply coupled to the pin VIN to a load coupled to the pin OUT. When the enable signal is invalid (for example, at a logic low level), the transistor M1 is turned off, and the energy transmission between the power supply and the load is ceased.

In some embodiments, the load switch 300 further includes a pin SS for coupling a soft-start capacitor. The soft-start capacitor Css is coupled between the pin SS and the reference ground, and is used to set a rising slope of the output voltage Vout during soft-start process. The pin SS is coupled to the first input terminal of the error amplifier AMP1 to provide the reference voltage Vref. A current source Iss is utilized to provide a charging current for the soft-start capacitor Css. When a valid enable signal is received at the pin EN, the current source Iss charges the soft-start capacitor Css, and the reference voltage Vref ramps up. The output voltage Vout also gradually increases with the reference voltage Vref, so as to effectively reduce an inrush current of the load switch when it is powered on.

In some embodiments, the rising slope of the output voltage Vout is proportional to the rising slope of the reference voltage Vref, and the proportional coefficient can be expressed as Kss. Therefore, the soft-start time of the output voltage Vout can be expressed as:

$$Tss = \frac{1}{Kss} * \frac{Vout * Css}{I ss} \tag{7}$$

In addition to the output soft start, the load switch 300 can also clamp a current Iout provided to the load, so as to improve system reliability. For example, the load switch 300 could further include a current sensing circuit 103, an error amplifier AMP3, and a transistor M3. The current sensing circuit 103 is configured to sense the current Iout and generate a sensing voltage Vcl. The error amplifier AMP3 has a first input terminal, a second input terminal and an output terminal, wherein the first input terminal is coupled to the current sensing circuit 103 to receive the sensing voltage Vcl, and the second input terminal is configured to receive a threshold voltage Vth_LMT. The transistor M3 has a first terminal, a second terminal and a control terminal, wherein the first terminal is coupled to the control terminal of the transistor M1, the second terminal is coupled to the reference ground, and the control terminal is coupled to the output terminal of the error amplifier AMP3. If the sensing voltage Vcl is higher than the threshold voltage Vth_LMT, the error amplifier AMP3 will control the transistor M3 to adjust the driving voltage at the control terminal of the transistor M1, thereby clamping the current Iout.

Generally speaking, sensing of the current Iout could be realized by detecting a current Im1 flowing through the transistor M1. The current sensing circuit 103 may include a current mirror coupled to the transistor M1, and a sensing resistor coupled to an output terminal of the current mirror. In some applications, in order to achieve an adjustable current clamp value, the load switch 300 could further be provided with a pin LMIT. This LMIT pin is coupled to the first input terminal of the error amplifier AMP3 and configured to couple an external sensing resistor (e.g., resistor Rcl as shown in FIG. 6). The resistor Rcl is coupled between the pin LMIT and the reference ground, and the current clamping value can be adjusted through changing the resistance of Rcl.

Figure 7:
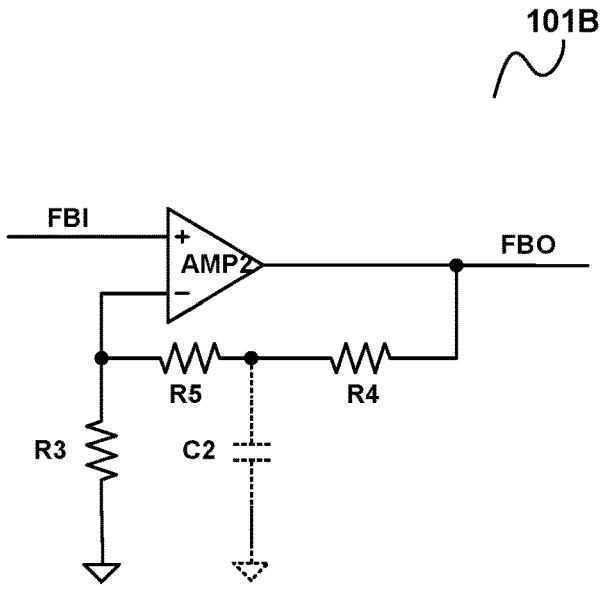
FIG. 7 and FIG. 8 are schematic diagrams of compensation circuits in accordance with different embodiments of the present invention.
Figure 8:
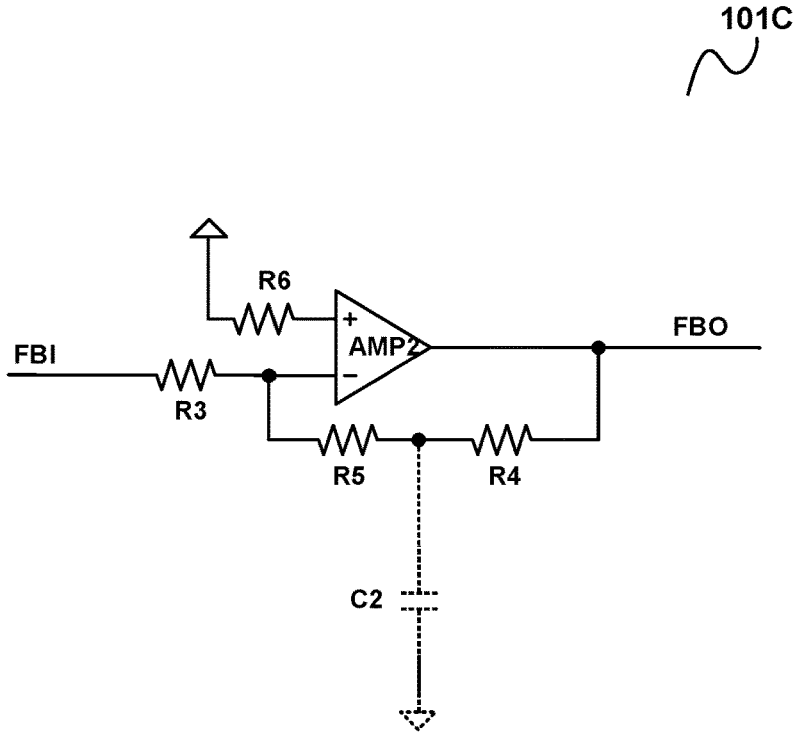

Besides the compensation circuit 101A shown in FIG. 3, persons of ordinary skills in the art can understand that, other suitable compensation circuits could also be used in the present invention, as long as they can effectively introduce zero points into the open-loop transfer function of the system. FIG. 7 and FIG. 8 are schematic diagrams of compensation circuits in accordance with different embodiments of the present invention.

The transfer function of the compensation circuit 101B shown in FIG. 7 can be expressed as:

$$Gc1 = K1 * (\tau 1S + 1) \tag{8}$$

Wherein $$K1 = \frac{R3 + R4 + R5}{R3} \tag{9}$$

$$\tau 1 = \frac{R4 * (R3 + R5)}{R3 + R4 + R5} * C2 \tag{10}$$

The transfer function of the compensation circuit 101C shown in FIG. 8 could be expressed as:

$$Gc2 = K2 * (\tau 2S + 1) \tag{11}$$

Wherein $$K2 = \frac{R4 + R5}{R3} \tag{12}$$

$$\tau 2 = \frac{R4 * R5}{R3 + R4} * C2 \tag{13}$$

Obviously many modifications and variations of the present invention are possible in light of the above teachings. It is therefore to be understood that within the scope of the appended claims the invention may be practiced otherwise than as specifically described. For instance, the transistor M1 in accordance with embodiments of the present invention could be anyone of NMOS, PMOS, PNP-BJT and NPN-BJT. And to deliver large current, the transistor M1 could be fabricated as a plurality of small transistors coupled in parallel. Furthermore, the amplifiers in embodiments of the present invention could be single stage amplifiers or multiple stage ones, and the configuration of their non-inverting and inverting input terminals could be adjusted or exchanged, as long as regulation of the output voltage Vout could be realized.

It should be understood, of course, the foregoing disclosure relates only to a preferred embodiment (or embodiments) of the invention and that numerous modifications may be made therein without departing from the spirit and the scope of the invention as set forth in the appended claims.

What is claimed is:

1. A linear voltage regulator comprising:

a first transistor having a first terminal, a second terminal and a control terminal, wherein the first terminal is configured to receive an input voltage, and the second terminal is configured to provide an output voltage;

a first error amplifier having a first input terminal, a second input terminal and an output terminal, wherein the first input terminal is configured to receive a reference voltage, and the output terminal is coupled to the control terminal of the first transistor;

a feedback circuit having an input terminal and an output terminal, wherein the input terminal is coupled to the second terminal of the first transistor to receive the output voltage, and the feedback circuit is configured to generate a feedback voltage lower than the output voltage at its output terminal; and a compensation circuit coupled between the output terminal of the feedback circuit and the second input terminal of the first error amplifier, and configured to generate a compensation voltage at the second input terminal of the first error amplifier based on the feedback voltage; wherein the compensation circuit includes a compensation capacitor and is configured to introduce a zero point into an open-loop transfer function of the linear voltage regulator to improve stability of the linear voltage regulator;

wherein the compensation circuit further comprises at least two compensation resistors, and the zero point introduced by the compensation circuit is $-1/\tau$, wherein $\tau$ is proportional to the capacitance of the compensation capacitor.

2. The linear voltage regulator of claim 1, wherein the feedback circuit comprises:

a first resistor having a first terminal and a second terminal, wherein the first terminal is coupled to the second terminal of the first transistor; and a second resistor having a first terminal and a second terminal, wherein the first terminal of the second resistor and the second terminal of the first resistor are coupled together to provide the feedback voltage, and the second terminal of the second resistor is coupled to a reference ground.

3. The linear voltage regulator of claim 1, wherein the compensation circuit further comprises:

an operational amplifier having a first input terminal, a second input terminal and an output terminal, wherein the first input terminal is coupled to the output terminal of the feedback circuit to receive the feedback voltage, and the output terminal is configured to provide the compensation voltage;

a third resistor coupled in parallel with the compensation capacitor, and coupled between the second input terminal of the operational amplifier and a reference ground; and a fourth resistor coupled between the second input terminal of the operational amplifier and the output terminal of the operational amplifier.

4. The linear voltage regulator of claim 1, further comprising:

a current source coupled to the first input terminal of the first error amplifier and configured to couple a soft-start capacitor.

5. The linear voltage regulator of claim 1, wherein the compensation circuit further comprises:

an operational amplifier having a first input terminal, a second input terminal and an output terminal, wherein the first input terminal is coupled to the output terminal of the feedback circuit to receive the feedback voltage, and the output terminal is configured to provide the compensation voltage;

a third resistor coupled between the second input terminal of the operational amplifier and a reference ground;

a fourth resistor coupled between the output terminal of the operational amplifier and a first terminal of the compensation capacitor, wherein the second terminal of the compensation capacitor is coupled to the reference ground; and a fifth resistor coupled between the second input terminal of the operational amplifier and the first terminal of the compensation capacitor.

6. The linear voltage regulator of claim 1, wherein the compensation circuit further comprises:

an operational amplifier having a first input terminal, a second input terminal and an output terminal, wherein the first input terminal is coupled to a reference ground, and the output terminal is configured to provide the compensation voltage;

a third resistor having a first terminal and a second terminal, wherein the first terminal is coupled to the output terminal of the feedback circuit to receive the feedback voltage, the second terminal is coupled to the second input terminal of the operational amplifier;

a fourth resistor coupled between the output terminal of the operational amplifier and a first terminal of the compensation capacitor, wherein the second terminal of the compensation capacitor is coupled to the reference ground; and a fifth resistor coupled between the second input terminal of the operational amplifier and the first terminal of the compensation capacitor.

7. A semiconductor integrated circuit, comprising:

a first pin configured to receive an input voltage;

a second pin configured to provide an output voltage;

a third pin coupled to a reference ground;

a first transistor having a first terminal, a second terminal and a control terminal, wherein the first terminal is coupled to the first pin, and the second terminal is coupled to the second pin;

a first error amplifier having a first input terminal, a second input terminal and an output terminal, wherein the first input terminal is configured to receive a reference voltage;

a second transistor having a first terminal, a second terminal and a control terminal, wherein the first terminal is coupled to the control terminal of the first transistor, the second terminal is coupled to the reference ground, and the control terminal is coupled to the output terminal of the first error amplifier;

a first resistor having a first terminal and a second terminal, wherein the first terminal is coupled to the second pin;

a second resistor having a first terminal and a second terminal, wherein the first terminal of the second resistor and the second terminal of the first resistor are coupled together to provide a feedback voltage, and the second terminal of the second resistor is coupled to the reference ground; and a compensation circuit having an input terminal and an output terminal, wherein the input terminal is coupled to receive the feedback voltage, and the output terminal is coupled to the second input terminal of the first error amplifier to provide a compensation voltage; wherein the compensation circuit includes a compensation capacitor and is configured to introduce a zero point into an open-loop transfer function of the linear voltage regulator to improve stability of the linear voltage regulator.

8. The semiconductor integrated circuit of claim 7, further comprising:

a fourth pin configured to receive an enable signal determining a working state of the semiconductor integrated circuit.

9. The semiconductor integrated circuit of claim 7, further comprising:

a current source coupled to the first input terminal of the first error amplifier; and a fifth pin coupled to the first input terminal of the first error amplifier and configured to couple a soft-start capacitor.

10. The semiconductor integrated circuit of claim 7, further comprising:

a sixth pin configured to couple a sensing resistor;

a current sensing circuit coupled to the sixth pin, wherein the current sensing circuit is configured to sense a current flowing through the first transistor and generate a sensing voltage at the sixth pin;

a second error amplifier having a first input terminal, a second input terminal and an output terminal, wherein the first input terminal is coupled to the sixth pin to receive the sensing voltage, and the second input terminal is configured to receive a threshold voltage; and a third transistor having a first terminal, a second terminal and a control terminal, wherein the first terminal is coupled to the control terminal of the first transistor, the second terminal is coupled to the reference ground, and the control terminal is coupled to the output terminal of the second error amplifier.

11. The semiconductor integrated circuit of claim 7, wherein the compensation circuit further comprises:

an operational amplifier having a first input terminal, a second input terminal and an output terminal, wherein the first input terminal is coupled to the output terminal of the feedback circuit to receive the feedback voltage, and the output terminal is configured to provide the compensation voltage;

a third resistor coupled in parallel with the compensation capacitor, and coupled between the second input terminal of the operational amplifier and the reference ground; and a fourth resistor coupled between the second input terminal of the operational amplifier and the output terminal of the operational amplifier.

12. The semiconductor integrated circuit of claim 7, wherein the compensation circuit further comprises at least two compensation resistors, and the zero point introduced by the compensation circuit is $-1/\tau$, wherein $\tau$ is proportional to the capacitance of the compensation capacitor.

13. The semiconductor integrated circuit of claim 7, wherein the compensation circuit further comprises:

an operational amplifier having a first input terminal, a second input terminal and an output terminal, wherein the first input terminal is coupled to the output terminal of the feedback circuit to receive the feedback voltage, and the output terminal is configured to provide the compensation voltage;

a third resistor coupled between the second input terminal of the operational amplifier and the reference ground;

a fourth resistor coupled between the output terminal of the operational amplifier and a first terminal of the compensation capacitor, wherein the second terminal of the compensation capacitor is coupled to the reference ground; and a fifth resistor coupled between the second input terminal of the operational amplifier and the first terminal of the compensation capacitor.

14. The semiconductor integrated circuit of claim 7, wherein the compensation circuit further comprises:

an operational amplifier having a first input terminal, a second input terminal and an output terminal, wherein the first input terminal is coupled to the reference ground, and the output terminal is configured to provide the compensation voltage;

a third resistor having a first terminal and a second terminal, wherein the first terminal is coupled to the output terminal of the feedback circuit to receive the feedback voltage, the second terminal is coupled to the second input terminal of the operational amplifier;

a fourth resistor coupled between the output terminal of the operational amplifier and a first terminal of the compensation capacitor, wherein the second terminal of the compensation capacitor is coupled to the reference ground; and a fifth resistor coupled between the second input terminal of the operational amplifier and the first terminal of the compensation capacitor.

15. A semiconductor integrated circuit, comprising:

a first pin configured to receive an input voltage;

a second pin configured to provide an output voltage;

a third pin coupled to a reference ground;

a fourth pin configured to receive an enable signal determining a working state of the semiconductor integrated circuit, a fifth pin configured to couple a soft-start capacitor, a sixth pin configured to couple a sensing resistor;

a first transistor having a first terminal, a second terminal and a control terminal, wherein the first terminal is coupled to the first pin, and the second terminal is coupled to the second pin;

a first error amplifier having a first input terminal, a second input terminal and an output terminal, wherein the first input terminal is coupled to the fifth pin to receive a reference voltage;

a current source coupled to the first input terminal of the first error amplifier;

a first resistor having a first terminal and a second terminal, wherein the first terminal is coupled to the second pin;

a second resistor having a first terminal and a second terminal, wherein the first terminal of the second resistor and the second terminal of the first resistor are coupled together to provide a feedback voltage, and the second terminal of the second resistor is coupled to the reference ground; and a compensation circuit having an input terminal and an output terminal, wherein the input terminal is coupled to receive the feedback voltage, and the output terminal is coupled to the second input terminal of the first error amplifier to provide a compensation voltage;

a second transistor having a first terminal, a second terminal and a control terminal, wherein the first terminal is coupled to the control terminal of the first transistor, the second terminal is coupled to the reference ground, and the control terminal is coupled to the output terminal of the first error amplifier;

a current sensing circuit coupled to the sixth pin, wherein the current sensing circuit is configured to sense a current flowing through the first transistor and generate a sensing voltage at the sixth pin;

a second error amplifier having a first input terminal, a second input terminal and an output terminal, wherein the first input terminal is coupled to the sixth pin to receive the sensing voltage, and the second input terminal is configured to receive a threshold voltage; and a third transistor having a first terminal, a second terminal and a control terminal, wherein the first terminal is coupled to the control terminal of the first transistor, the second terminal is coupled to the reference ground, and the control terminal is coupled to the output terminal of the second error amplifier.

16. The semiconductor integrated circuit of claim 15, wherein the compensation circuit comprises:

a compensation capacitor;

an operational amplifier having a first input terminal, a second input terminal and an output terminal, wherein the first input terminal is coupled to the output terminal of the feedback circuit to receive the feedback voltage, and the output terminal is configured to provide the compensation voltage;

a third resistor coupled in parallel with the compensation capacitor, and coupled between the second input terminal of the operational amplifier and the reference ground; and a fourth resistor coupled between the second input terminal of the operational amplifier and the output terminal of the operational amplifier.

17. The semiconductor integrated circuit of claim 15, wherein the compensation circuit comprises:

a compensation capacitor;

an operational amplifier having a first input terminal, a second input terminal and an output terminal, wherein the first input terminal is coupled to the output terminal of the feedback circuit to receive the feedback voltage, and the output terminal is configured to provide the compensation voltage;

a third resistor coupled between the second input terminal of the operational amplifier and the reference ground;

a fourth resistor coupled between the output terminal of the operational amplifier and a first terminal of the compensation capacitor, wherein the second terminal of the compensation capacitor is coupled to the reference ground; and a fifth resistor coupled between the second input terminal of the operational amplifier and the first terminal of the compensation capacitor.

18. The semiconductor integrated circuit of claim 15, wherein the compensation circuit comprises:

a compensation capacitor;

an operational amplifier having a first input terminal, a second input terminal and an output terminal, wherein the first input terminal is coupled to the reference ground, and the output terminal is configured to provide the compensation voltage;

a third resistor having a first terminal and a second terminal, wherein the first terminal is coupled to the output terminal of the feedback circuit to receive the feedback voltage, the second terminal is coupled to the second input terminal of the operational amplifier;

a fourth resistor coupled between the output terminal of the operational amplifier and a first terminal of the compensation capacitor, wherein the second terminal of the compensation capacitor is coupled to the reference ground; and a fifth resistor coupled between the second input terminal of the operational amplifier and the first terminal of the compensation capacitor.

* * * * *